United States Patent [19]

Diamond

[11] 3,987,885

[45] Oct. 26, 1976

[54] AUTOMATIC SINGLE AND REPEAT FUNCTION MECHANISM FOR TYPEWRITERS

[75] Inventor: Herrick R. Diamond, Homer, N.Y.

[73] Assignee: SCM Corporation, New York, N.Y.

[22] Filed: June 23, 1975

[21] Appl. No.: 589,727

[52] U.S. Cl. ..... 197/91; 197/151; 197/181

[51] Int. Cl.[2] ..... B41J 19/62; B41J 33/02

[58] Field of Search ..... 197/82, 83, 91, 151, 197/168, 169, 181, 107, 6.7; 242/55, 57

[56] References Cited

UNITED STATES PATENTS

| | | | |
|---|---|---|---|
| 1,475,619 | 11/1923 | Barney | 197/51 |
| 1,608,279 | 11/1926 | Handley | 197/51 |
| 3,194,379 | 7/1965 | Szeluga | 197/151 |
| 3,204,746 | 9/1965 | Wolowitz | 197/181 X |
| 3,346,090 | 10/1967 | Goff et al. | 197/158 |
| 3,632,052 | 1/1972 | Read | 197/160 X |
| 3,637,060 | 1/1972 | McMahon | 197/6.7 |
| 3,643,778 | 2/1972 | Anderson | 197/151 |
| 3,729,081 | 4/1973 | Ozimek et al. | 197/181 X |
| 3,804,227 | 4/1974 | Cappotto et al. | 197/151 |
| 3,882,990 | 5/1975 | Genesio | 197/181 |
| 3,927,746 | 12/1975 | Wolowitz | 197/151 |
| 3,927,747 | 12/1975 | Wolowitz | 197/151 |
| 3,927,748 | 12/1975 | Wolowitz | 197/181 |
| 3,927,749 | 12/1975 | Wolowitz | 197/181 |

*Primary Examiner*—Edgar S. Burr
*Assistant Examiner*—Paul T. Sewell
*Attorney, Agent, or Firm*—Stanley J. Klem; Milton M. Wolson

[57] ABSTRACT

A method and mechanism for automatic actuation of single and repeat typewriter functions such as backspacing upon the insertion and removal of a ribbon cartridge. The ribbon cartridge, carrying a bidirectional camming abutment having a pair of converging cam surfaces is inserted into the typewriter, whereupon a first cam surface engages a backspace coupled cam lever within the typewriter, thereby actuating a typewriter backspace function. The cam lever includes a pair of convergingly directed cam surfaces joined by a dwell surface. As the cartridge camming abutment contacts the dwell surface, it actuates a repeat backspace function until the camming abutment passes beyond the dwell surface of the cam lever. The camming abutment includes a second cam surface that engages a second cam surface disposed on the cam lever to actuate a backspace function upon removal of the ribbon cartridge. Particularly adaptable to correcting typing errors, the present invention will minimize the manipulations now necessary to perform an error correcting operation. Therefore, an automatic single or repeat typewriter backspace function is actuated simply by inserting and removing a ribbon cartridge during an error correcting operation.

53 Claims, 5 Drawing Figures

AUTOMATIC SINGLE AND REPEAT FUNCTION MECHANISM FOR TYPEWRITERS

BACKGROUND OF THE INVENTION

The present invention relates to mechanisms for typewriters that utilize ribbon cartridges in general and include those of the type disclosed in U.S. Pat. No. 3,643,777 entitled TYPEWRITER RIBBON CARTRIDGE granted Feb. 22, 1972 and U.S patent application Ser. No. 150,946 filed June 9, 1971 with Carl Anderson et al. as inventors and entitled TYPEWRITER RIBBON CARTRIDGE, both of which are assigned to the assignee of the instant application. The term "cartridge" as used hereinafter is defined to include any form of ribbon holder or container irrespective of configuration and the manner of insertion into the typewriter.

More particularly, the present invention relates to typewriters and to the automatic actuation of single and repeat backspace functions upon insertion and removal of the ribbon cartridge.

A recommended typewriter function that may be accomplished by the actuating mechanism of this invention is to provide an automatic backspace operation, either singly or repeatedly, upon the insertion and removal of a cartridge. A typical backspace operation that may be automated by the actuating mechanism of this invention is fully disclosed in U.S. Pat. No. 3,482,671 entitled BACK SPACE MECHANISM FOR TYPEWRITERS granted on Dec. 9, 1969 with Richard Shattuck as inventor and assigned to the same assignee as the instant application.

The term "typewriter function" is defined to include any typewriter operation which provides for the alignment of a selected platen impact point relative to the typewriter print point.

When cooperating with a modified cartridge housing an error correction tape therein, several manipulative steps previously necessary for an error correction operation are directly eliminated.

Correcting typing errors have required a series of backspace operations in order to complete the error correcting operation. The end result of the necessary series of backspacing operations is that the typing speed is significantly reduced, thereby increasing the time and cost for the preparatioin of the typed material. For example, it may be several letter spaces beyond where an erroneous character is typed before a typist notices the error. It is necessary that the carriage be manually repositioned to the printing station of the error or alternatively, the backspace key be depressed to accomplish the same in order for the error to be corrected.

The present invention, as it relates to error correction, improves the efficiency with which an error correction operation may be completed by providing an automatic single and repeat backspace operation upon the insertion and removal of a ribbon cartridge. The invention is clearly not intended to apply only to the foregoing, but may readily be applied in conjunction with any related typewriter function.

Other advantages of the present invention will become more fully apparent from the following description.

SUMMARY OF THE INVENTION

The inventive concept disclosed contemplates the means for the automatic single and repeat actuation of a selected typewriter function upon the insertion and removal of a ribbon cartridge. The inventive concept as applied to automatic backspacing is illustrated in cooperation with a typewriter ribbon cartridge containing an error correction ribbon that includes two abutments. The ribbon cartridge containing error correction ribbon will be hereafter referred to as an error correction ribbon cartridge.

The abutment is disposed on and projects from the wall of the ribbon cartridge and engages the automatic backspacing upon insertion of the ribbon cartridge into the typewriter and again upon removal therefrom. A ribbon cartridge platform fixed within the typewriter provides support for the ribbon cartridge. An upstanding wall of the ribbon cartridge platform has pivotally disposed thereon, an actuating lever that is coupled to a typewriter backspace mechanism. The uppermost edge of the actuating lever defines two cam surfaces with a dwell area therebetween. The top edge of the actuating lever is disposed in the insertion path of the ribbon cartridge.

When an error correction operation is desired, the printing ribbon cartridge is removed from the typewriter and replaced by the error correction ribbon cartridge. Upon insertion of the error correction ribbon cartridge, a first cam surface on the wall of the error correction ribbon cartridge progressively engages a first cam surface on the actuating lever. The actuating lever is urged to pivot down and, through linkage, actuates a backspace function to reposition the typewriter carriage to the proper printing station for completion of the error correction operation. The insertion of the error correction ribbon cartridge is thereafter continued until it is fully inserted in the typewriter. In the event the carriage has traversed several letter spaces before the typist notices the error, or the error involves more than one character, the error correction ribbon cartridge is only partially inserted. The first cam surface of the error correction ribbon cartridge contacts a dwell area that is provided on the actuating lever whereby backspace functions are repeatedly actuated until the error correction ribbon cartridge is fully inserted whereupon the first cam surface of the error correction ribbon cartridge is displaced therefrom. The error correction ribbon cartridge is then removed from the typewriter.

Upon removal of the error correction ribbon cartridge from the typewriter, a second cam surface on the wall of the error correction ribbon cartridge progressively engages a second cam surface on the actuating lever. The actuating lever is again urged to pivot down and, through linkage actuates a backspace function to reposition the typewriter carriage to the proper printing station. The error correction ribbon cartridge is then either quickly removed if one character has been corrected to actuate a single backspace function, or partially removed if more than one character has been corrected to actuate multiple backspace functions, and thereafter fully removed therefrom. The printing ribbon cartridge is then inserted and normal typing operation is continued.

Accordingly, it is an object of the present invention to provide a method and means for automatically actuating a selected typewriter function upon the insertion of a ribbon cartridge.

It is another object of the present invention to provide a method and means for automatically actuating a selected typewriter function upon the removal of a ribbon cartridge.

A further object of the present invention is to provide a method and means for repeatedly automatically actuating a selected typewriter function upon the insertion of a ribbon cartridge.

A still further object of the present invention is to provide a method and means for repeatedly automatically actuating a selected typewriter function upon the removal of a ribbon cartridge.

A still further object of the present invention is to provide a mechanism that automates the backspacing operation of a typewriter when performing an operation requiring backspacing, and in particular an error correction operation.

A still further object of the present invention is methods and means to automatically and precisely reposition the carriage of a typewriter for typing over a previously typed character without manual manipulation.

Other objects, features, and advantages of the invention will become more apparent from the following description, including appended claims, and accompanying drawing.

DESCRIPTION OF THE PREFERRED EMBODIMENT

It should be understood that the following embodiment has, for the purpose of clarity and ease of description, been confined to a common and readily employed function, namely, backspacing for error correction. The principle of this invention can be readily applied to other typewriter functions utilizing the embodiment described herein as an example.

Figure 1:
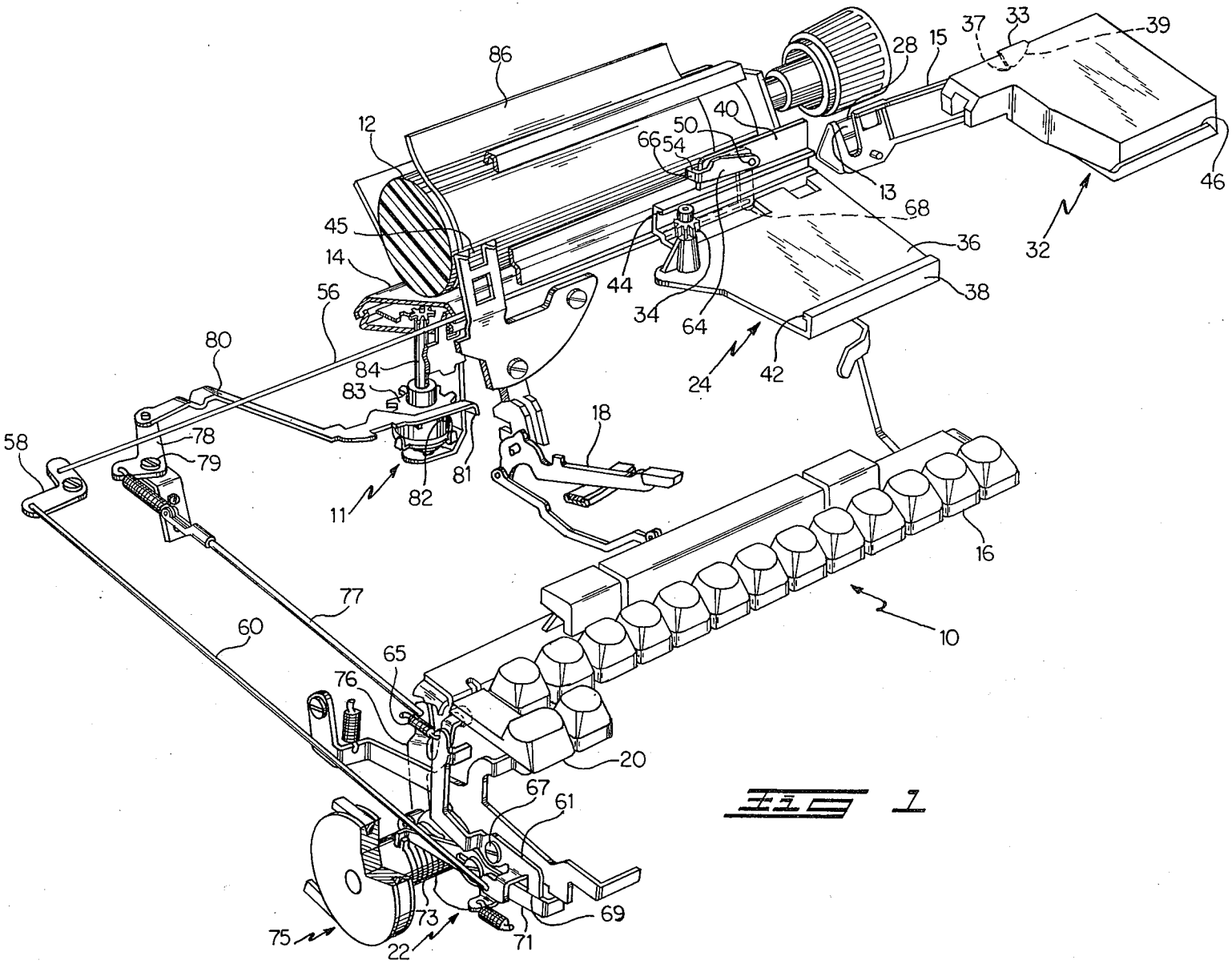
FIG. 1 is a perspective view of portions of a typewriter incorporating the invention.

The illustrated embodiment as depicted in FIG. 1 shows a typewriter 10 with a printing platen 12 supported on an incrementally traversable carriage 14, the movement of which is controlled by an escapement mechanism 11, such as the type that is fully disclosed in U.S. Pat. No. 2,649,179 entitled CARRIAGE FEEDING ESCAPEMENT MECHANISM and having the same assignee as the instant application. Typewriter 10 also includes a plurality of character keys 16 for actuating a plurality of typebars 18, only one of which is shown, and a function key 20 for actuating a typewriter backspace mechanism 22.

Although a backspace function key has been selected for clarity of illustration, other function keys such as carriage return, shift, and margin release are also found in typewriters.

A ribbon cartridge platform 24 is fixed within typewriter 10 that provides a support for a ribbon cartridge of the type described in the above referred to patent application, assigned to the present assignee, or may be readily adapted to accept a variety of structurally different cartridges. Within a cartridge housing there may be disposed a variety of ribbons including a correction ribbon 28. For the sake of clarity, only a ribbon cartridge 32 containing error correction ribbon 28 is distinguished structurally as shown in the drawings. Ribbon cartridge platform 24 is precisely positioned to provide support for ribbon cartridges of the foregoing type to align a printing station 13 of a cartridge ribbon carrier arm 15 with a printing station 45 of the typewriter 10 when ribbon cartridges are inserted into the typewriter. Ribbon cartridge platform 24 further includes a feed means 34 that is engageable by a ribbon cartridge to feed ribbon along the arm.

The structure of ribbon cartridge platform 24 as illustrated in FIG. 1 includes a flat base 36 having a pair of integral walls 38 and 40 extending upwards therefrom. Walls 38 and 40 are parallel to and spaced from one another to provide precise guiding for the ribbon cartridge during insertion. Walls 38 and 40 include opposed overhanging retaining shelves 42 and 44. Shelves 42 and 44 overlie cooperating ledges 46 and 48 of the ribbon cartridge to prevent upward movement of the cartridge upon insertion into typewriter 10.

The invention as embodied in the automatic backspace mechanism most clearly illustrated in FIG. 1 includes an actuating lever 54 coupled to backspace mechanism 22 by a link 56, a bellcrank 58, and a link 60. Link 56 connects actuating lever 54 to bellcrank 58 and a second link 60 connects bellcrank 58 to backspace lever 61. Therefore, any movement of actuating lever 54 is linearly transmitted to actuate the backspace actuating mechanism 22. Although the linkage depicted is preferred, any other suitable mechanical linkage between actuating lever 54 and backspace mechanism 22 may be employed.

Typewriter 10 is provided with means for actuating its backspace function that may be disposed proximate the opening that receives the ribbon cartridge 32 as shown in the drawings.

The backspace actuating mechanism includes a cam lever 54 that is connected through linkage 56, 58, and 60, to a typewriter backspace mechanism 22. The typewriter backspace mechanism is fully disclosed in detail in co-pending U.S. patent application entitled AUTOMATIC FUNCTION MECHANISM FOR TYPEWRITERS filed simultaneously with the instant application with Samuel D. Cappotto as sole inventor and assigned to the same assignee.

As shown in FIGS. 2–5, cam lever 54 includes a pair of parallel spaced apart arms 62 and 64 joined at one end by a base 66 to form a generally "U" shaped upper configuration. Cam lever 54 is supported for pivotal movement about a pivot shaft 50 which passes through lever 54 proximate the juncture of arm 62 and its downward transverse extension 68 through an upstanding wall 40 of a ribbon cartridge platform 24 and terminates in an aligned aperture 63 of arm 64. Platform wall 40 terminates proximate base 66 thereby permitting support and pivotal action thereof. Arm 64 which is disposed on the side of platform wall 40 that receives ribbon cartridge 32 has its uppermost edge formed by two converging cam surfaces 72 and 74 with an intermediate flat dwell area 70 therebetween.

A cartridge 32, suitable for proper actuating of a selected typewriter function is provided with an abutment 33. Abutment 33 is disposed at the uppermost portion of a wall 35 of error correction ribbon cartridge 32 and projects outwardly therefrom, a sufficient distance to intersect actuating lever 54 upon insertion and removal of the cartridge. Abutment 33 is of triangular form to define camming surfaces 37 and 39. Camming surfaces 37 and 39 are disposed for slideable engagement and actuation of actuator lever 54 upon insertion and removal of error correction ribbon cartridge 32.

During normal practice when a typist types an erroneous character on a typewriter having an automated backspace mechanism disposed therein and when the error is discovered after several following characters have been typed, the automatic function mechanism of the present invention may then be most advantageously employed.

Figure 2:
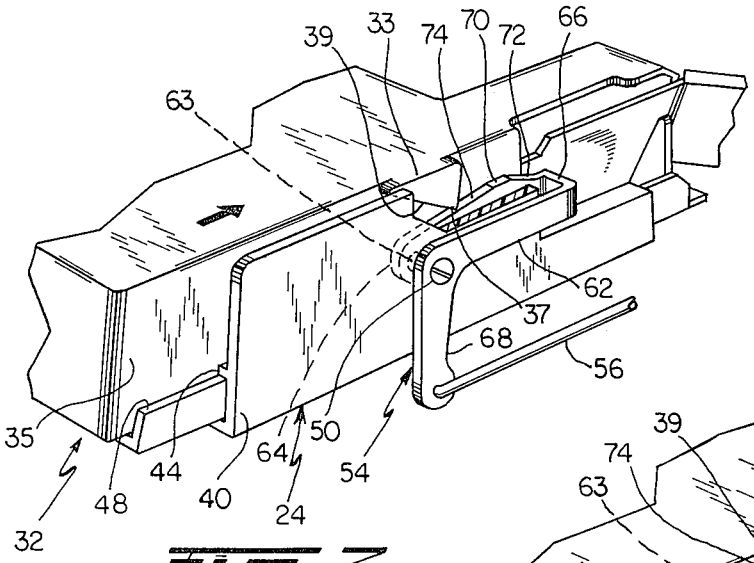
FIG. 2 is an enlarged rear perspective view of a portion of the ribbon cartridge as it is being inserted into the typewriter.

A sequence of operations are required to perform an error correcting operation after first removing the printing ribbon cartridge. The typist progressively inserts error correction ribbon cartridge 32 into typewriter 10 where it is guided by ribbon cartridge platform 24. As illustrated in FIG. 2, cartridge abutment cam surface 37 progressively engages cam surface 74 of actuating lever 54. Actuating lever 54 is thereby urged to pivot downward about pivot shaft 50. As cam lever 54 pivots downward, extension 68 pulls link 56 rightward as viewed in FIG. 1 and by way of bellcrank 58, overcomes the biasing effect of a spring 65 to pull link 60 rearward. The rearward movement of link 60 urges backspace lever 61 to pivot clockwise about its mounting pivot 67. A forward extending arm 69 of backspace lever 61 engages and urges bellcrank 71 to pivot clockwise and actuate backspace mechanism 22 to reposition typewriter carriage 14 to the proper print station for making the correction.

A backspace function is actuated when bellcrank 71 pivots clockwise thereby actuating a spring clutch 73 to couple backspace mechanism 22 with a power source 75. A bellcrank 76 pivots clockwise and pulls a link 77 frontward, which in turn pivots an intermediate bellcrank 78 counterclockwise about a pivot pin 79. Intermediate bellcrank 78 drives a backspace link 80 toward the left, which causes a tab 81 to engage a tooth 82 of a starwheel 83. Starwheel 83 rotates clockwise about a shaft 84 thereby backspacing carriage 14 one letter space.

Figure 3:
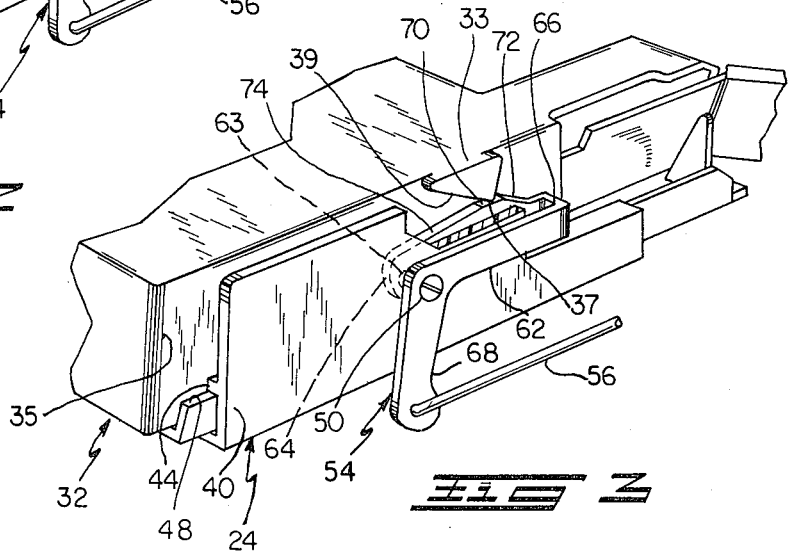
FIG. 3 is a view as shown in FIG. 2 with the ribbon cartridge in the repeat mode of operation.
Figure 4:
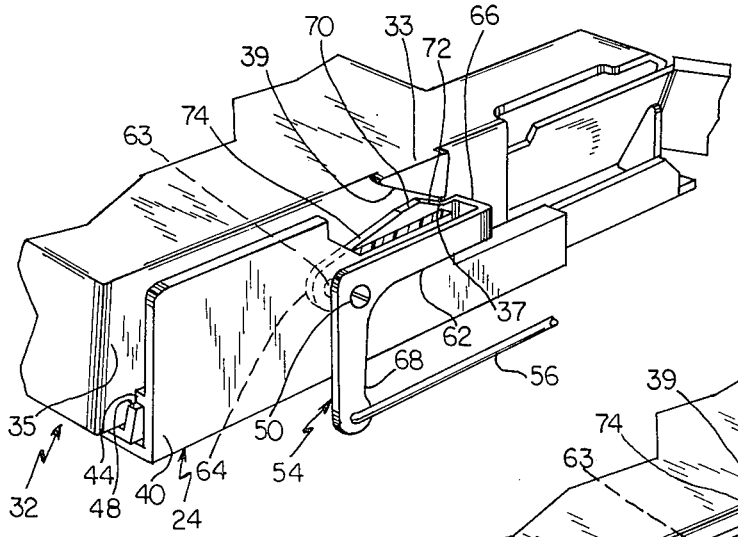
FIG. 4 is a view as shown in FIG. 2 with the ribbon cartridge in the fully inserted state.

Further insertion of the cartridge progressively increases the engagement of cam surface 37 with actuating lever 54 until cam surface 37 engages dwell area 70 as illustrated in FIG. 3 to hold actuating lever 54 in its actuated mode. The backspace function is thereby repeadedly actauted until the proper printing station is in alignment for error correction. Repeat actuation of the backspace function occurs when spring clutch 73 is conditioned in its actuated mode by actuating lever 54 and its connecting linkage 56, 58, and 60. Therefore, backspace mechanism 22 is coupled to power source 75 without interruption to cause a repeat backspace function. The cartridge is then fully inserted to disengage abutment 33 from actuating lever 54 as illustrated in FIG. 4 and lever 54 is biased to its actuable modes by spring 65, and backspace mechanism 22 rendered inactive. The erroneously typed characters are thereafter overstruck and white correction material from correction ribbon 28 is deposited on writing paper 86 to render the erroneously struck characters semi-invisible.

Figure 5:
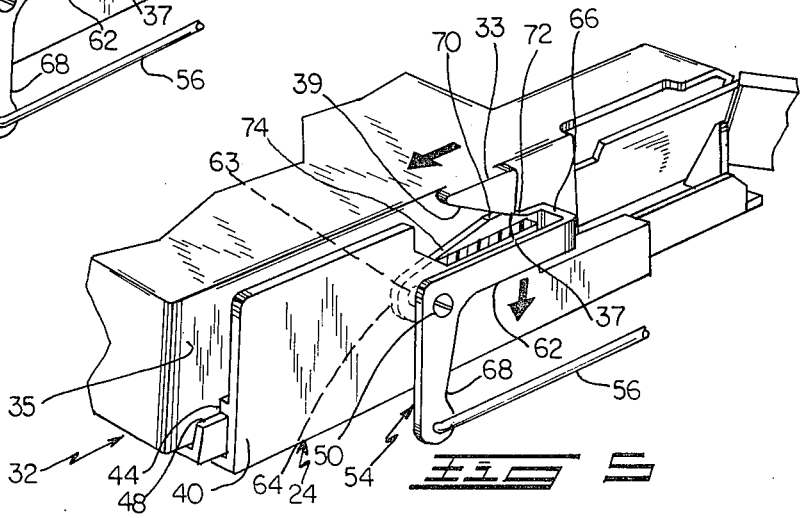
FIG. 5 is a view as shown in FIG. 4 showing the ribbon cartridge being removed.

The backspace function is again repeatedly actuated to reposition carriage 14 to the letter space station corresponding to the first erroneous character printed by simply progressively removing error correction ribbon cartridge 32. As illustrated in FIG. 5, catridge abutment cam surface 39 progressively engages cam surface 72 of actuating lever 54. Actuating lever 54 is thereby urged to pivot downward and through linkage previously mentioned above, backspace mechanism 22 is actuated to backspace carriage 14 one letter space.

Further removal of the cartridge causes abutment cam surface 39 to slide upon lever cam surface 72 until adjacent abutment cam surface 37 engages dwell area 70 to maintain actuating lever 54 in its actuated mode. The backspace function is again repeatedly actuated as illustrated in FIG. 3 until the proper printing station is in alignment for re-typing. Error correction ribbon cartridge 32 is then fully removed and the printing ribbon cartridge is installed and normal typing is continued.

It is clear from the above description that where a typewriter is adapted with means for repeatedly actuating a selected typewriter function, the use thereof requires only the steps of inserting and removing a suitable cartridge.

While the foregoing description has shown and described the fundamental novel features as applied to the preferred embodiment, it will be understood by those skilled in the art that modifications embodied in various forms may be made without departing from the spirit and scope of the invention.

What is claimed is:

1. In a typewriter which includes operational means for said typewriter to perform at least one typewriter function for causing the alignment of a selected platen impact point relative to the typewriter print point and having a platform for receiving a cartridge comprising:

means disposed in the typewriter and engageable by the cartridge for selectively either singly or repeatedly actuating said operational means upon a single insertion of the cartridge into the typewriter to thereby perform at least a selected one of said functions.

2. In a typewriter as defined in claim 1 wherein said receiving platform is fixed in the typewriter.

3. In a typewriter as defined in claim 1 wherein said actuating means includes means responsive to contact with said cartridge for singly or repeatedly actuating the typewriter function when the cartridge is being inserted into the typewriter.

4. In a typewriter as defined in claim 3 wherein said responsive means includes a lever pivotally carried by said typewriter in the path of travel of the cartridge when the cartridge is being inserted into the typewriter.

5. In a typewriter as defined in claim 2 wherein said typewriter further includes a function mechanism and said actuating means includes means on said receiving platform responsive to said cartridge for singly or repeatedly actuating said function mechanism when the cartridge is being inserted into the typewriter.

6. In a typewriter as defined in claim 5 wherein said responsive means includes a lever pivotally disposed on a wall of the ribbon cartridge platform and in the path of travel of the cartridge for engaging the cartridge upon insertion into the typewriter.

7. In a typewriter as defined in claim 6 wherein said responsive means further includes linkage means operatively connected to said function mechanism for transmitting motion from said lever to said function mechanism.

8. In a typewriter as defined in claim 2 wherein said actuating means further includes means on said receiving platform responsive to contact with another surface for singly or repeatedly actuating a function mechanism upon the insertion of a cartridge which cartridge is provided with a surface that will contact said responsive means.

9. In a typewriter as defined in claim 2 wherein said actuating means further includes dwell means on said receiving platform responsive to said cartridge for repeatedly actuating the operational means of the typewriter to thereby perform a typewriter function.

10. The typewriter according to claim 9 wherein said means on said platform is a lever carried thereby.

11. In a typewriter having operational means to perform at least one typewriter function for causing the alignment of a selected platen impact point relative to the typewriter print point and having a platform for receiving a cartridge comprising:

means disposed in the typewriter and engageable by the cartridge for selectively either singly or repeatedly actuating the operational means upon a single removal of the cartridge from the typewriter to thereby perform the typewriter function.

12. In a typewriter as defined in claim 11 wherein the receiving platform is fixed in the typewriter.

13. In a typewriter as defined in claim 11 wherein said actuating means includes means responsive to contact with the cartridge for singly or repeatedly actuating the operational means when the cartridge is being removed from the typewriter.

14. In a typewriter as defined in claim 13 wherein said responsive means includes a lever pivotally carried by the typewriter and disposed in the path of travel of the cartridge upon removal of the cartridge from the typewriter.

15. In a typewriter as defined in claim 12 wherein the typewriter includes a function mechanism and said actuating means includes means on the receiving platform responsive to said cartridge for singly or repeatedly actuating the function mechanism upon removal of the cartridge from the typewriter.

16. In a typewriter as defined in claim 15 wherein said responsive means includes a lever pivotally disposed on a wall of the ribbon cartridge platform and in the path of travel of the cartridge for engaging the cartridge upon insertion into the typewriter.

17. In a typewriter as defined in claim 16 wherein said responsive means further includes linkage means operatively connected to the function mechanism for transmitting motion from said lever to the function mechanism.

18. In a typewriter as defined in claim 12 wherein said actuating means further includes means on said receiving platform responsive to contact with another surface for singly or repeatedly actuating the operational means upon the insertion of a cartridge which cartridge is provided with a surface that will contact said responsive means.

19. In a typewriter as defined in claim 12 wherein said actuating means further includes dwell means on said receiving platform responsive to the cartridge for repeatedly actuating the function mechanism of the typewriter.

20. The typewriter according to claim 19 wherein said dwell means on said platform is an abutment carried thereby.

21. In a typewriter having operational means to perform a carriage backspacing function and a platform for receiving a ribbon cartridge, comprising:

means disposed in the typewriter and engageable by the ribbon cartridge for selectively either singly or repeatedly actuating the operational means upon a single insertion of the ribbon cartridge into the typewriter to thereby perform the backspacing function.

22. In a typewriter as defined in claim 21 wherein the receiving platform is fixed in the typewriter.

23. In a typewriter as defined in claim 21 wherein said actuating means includes an abutment disposed on a wall of the ribbon cartridge and further includes means on the receiving platform responsive to contact with said abutment for singly or repeatedly actuating the operational means when the ribbon cartridge is being inserted into the typewriter.

24. In a typewriter as defined in claim 23 wherein said responsive means includes a lever pivotally disposed on a wall of the ribbon cartridge platform and is disposed in the path of travel of the ribbon cartridge for engaging said abutment when the ribbon cartridge is being inserted into the typewriter.

25. In a typewriter as defined in claim 24 wherein said responsive means further includes linkage means operatively connected to the operational means for transmitting motion from said lever to the operational means.

26. In a typewriter as defined in claim 21 wherein said actuating means further includes dwell means on the receiving platform responsive to the ribbon cartridge for repeatedly actuating the operational means.

27. In a typewriter having operational means to perform a carriage backspacing function and a platform for receiving a ribbon cartridge comprising:

means disposed in the typewriter and engageable by the ribbon cartridge for selectively either singly or repeatedly actuating the operational means upon a single removal of the ribbon cartridge from the typewriter to thereby perform the the backspacing function.

28. In a typewriter as defined in claim 27 wherein the receiving platform is fixed in the typewriter.

29. In a typewriter as defined in claim 27 wherein said actuating means includes an abutment disposed on a wall of the ribbon cartridge and further includes means on the receiving platform responsive to contact with said abutment for singly or repeatedly actuating the operational means upon removal of the ribbon cartridge from the typewriter.

30. In a typewriter as defined in claim 29 wherein said responsive means includes a lever pivotally disposed on a wall of the ribbon cartridge platform and in the path of travel of the ribbon cartridge for engaging said abutment when the ribbon cartridge is being removed from the typewriter.

31. In a typewriter as defined in claim 30 wherein said responsive means further includes linkage means operatively connected to the operational means for transmitting motion from said lever to the operational means.

32. In a typewriter as defined in claim 28 wherein said actuating means further includes dwell means on the receiving platform responsive to the ribbon cartridge for repeatedly actuating the operational means.

33. In a typewriter of the type which receives an insertable and removable ribbon cartridge and is provided with a backspacing mechanism, the improvement comprising:

means carried by the typewriter for operationally activating the backspace mechanism; and co-acting means carried by the ribbon cartridge for selectively either singly or repeatedly actuating said activating means of the typewriter to initiate the backspace mechanism upon a single insertion of the ribbon cartridge.

34. In a typewriter as defined in claim 33 wherein said activating means includes a lever pivotally disposed in the path of the ribbon cartridge and said co-acting means includes an abutment disposed on the ribbon cartridge for engaging said lever when the ribbon cartridge is inserted into the typewriter.

35. In a typewriter as defined in claim 34 wherein said activating means further includes linkage means operatively connected to the backspace mechanism for transmitting motion from said lever to the backspace mechanism.

36. In a typewriter of the type which receives an insertable and removable ribbon cartridge and is provided with a backspacing mechanism, the improvement comprising:

means carried by the typewriter for operationally activating the backspace mechanism; and co-acting means carried by the ribbon cartridge for selectively either singly or repeatedly actuating said activating means of the typewriter to initiate the backspace mechanism upon a single removal of the ribbon cartridge.

37. In a typewriter as defined in claim 36 wherein said activating means includes a lever pivotally disposed in the path of the ribbon cartridge and said co-acting means includes an abutment disposed on the ribbon cartridge for engaging said lever when the ribbon cartridge is removed from the typewriter.

38. In a typewriter as defined in claim 37 wherein said activating means further includes linkage means operatively connected to the backspace mechanism for transmitting motion from said lever to the backspace mechanism.

39. A backspacing mechanism for typewriters that utilize ribbon cartridges, the typewriter having an incrementally traversable printing platen for supporting a printing medium, a plurality of typebars for impacting on the printing medium during traversing, a plurality of keys for actuating the typebars and other typewriter instrumentalities, a backspace mechanism responsive to another key for incrementally reversing the forward traverse of the printing platen, a ribbon cartridge platform fixed in the typewriter for supporting and guiding the ribbon cartridge into the typewriter to position a ribbon at a printing station in front of the printing medium whereby the key actuated typebars impact thereon to transfer character images through the ribbon of the ribbon cartridge to the printing medium, wherein the improvement comprises in combination:

means on the ribbon cartridge for selectively either singly or repeatedly actuating the backspacing mechanism; and means on the ribbon cartridge platform responsive to the ribbon cartridge actuating means for actuating the backspace mechanism in a single or repeat mode when the ribbon cartridge is partially inserted into the typewriter.

40. A backspacing mechanism as defined in claim 39 wherein said actuating means includes an abutment on a wall of the ribbon cartridge and said responsive means includes a lever that is pivotally supported on a wall of the ribbon cartridge platform and engageable by said abutment for pivotal movement relative to said platform wall.

41. An automatic backspacing mechanism for typewriters that utilize ribbon cartridges, the typewriter having an incrementally traversable printing platen for supporting a printing medium, a plurality of typebars for impacting on the printing medium during traversing, a plurality of keys for actuating the typebars and other typewriter instrumentalities, a backspace mechanism responsive to another key for incrementally reversing the forward traverse of the printing platen, a ribbon cartridge platform fixed in the typewriter for supporting and guiding the ribbon cartridge into the typewriter to position a ribbon at a printing station in front of the printing medium whereby the key actuated typebars impact thereon to transfer character images through the ribbon of the ribbon cartridge to the printing medium, wherein the improvement comprises:

means on the ribbon cartridge for selectively either singly or repeatedly actuating the backspacing mechanism; and means on the ribbon cartridge platform responsive to the ribbon cartridge actuating means for actuating the backspace mechanism in a single or repeat mode when the ribbon cartridge is partially removed from the typewriter.

42. An automatic backspacing mechanism as defined in claim 41 wherein said actuating means includes an abutment on a wall of the ribbon cartridge and said responsive means includes a lever that is pivotally supported on a wall of the ribbon cartridge platform and engageable by said abutment for pivotal movement relative to said platform wall.

43. An automatic backspacing mechanism for a typewriter that utilizes a ribbon cartridge comprising, in combination:

a camming abutment on the ribbon cartridge; and a cam lever in the typewriter coupled to the typewriter backspace mechanism and engageable by said camming abutment to actuate the backspace mechanism selectively either in a single or repeat mode when the ribbon cartridge is partially inserted into the typewriter.

44. An automatic backspacing mechanism as defined in claim 43 wherein said camming abutment includes a pair of converging cam surfaces.

45. An automatic backspacing mechanism as defined in claim 44 wherein said cam lever includes a pair of converging cam surfaces joined by a dwell surface therebetween for engaging said abutment cam surfaces to actuate the backspace mechanism in a single or repeat mode when the ribbon cartridge is partially inserted into the typewriter.

46. An automatic backspacing mechanism for a typewriter that utilizes a ribbon cartridge comprising, in combination:

a camming abutment on the ribbon cartridge; and a cam lever in the typewriter coupled to the typewriter backspace mechanism and engageable by said camming abutment to actuate the backspace mechanism selectively either in a single or repeat mode when the ribbon cartridge is partially removed from the typewriter.

47. An automatic backspacing mechanism as defined in claim 46 wherein said camming abutment includes a pair of converging cam surfaces.

48. An automatic backspacing mechanism as defined in claim 47 wherein said cam lever includes a pair of converging cam surfaces joined by a dwell surface therebetween for engaging said abutment cam surfaces to actuate the backspace mechanism in a single or repeat mode when the ribbon cartridge is partially removed from the typewriter.

49. A method for actuating selectively either a single or repeat functional operation for causing the alignment of a selected platen impact relative to the typewriter print point of a typewriter mechanism independent of a function key, which comprises:

inserting a ribbon cartridge into a typewriter to thereby effect said single or repeat functional operation.

50. A method for controlling the operation of a typewriter mechanism, which comprises:

moving a surface on a typewriter ribbon cartridge against a structure in the typewriter for effecting selectively either a single or repeat function for causing the alignment of a selected platen impact point relative to the typewriter print point of the typewriter mechanism independent of a function key.

51. A method for automatically actuating selectively either a single or repeat backspace mechanism of a typewriter which comprises:

inserting a ribbon cartridge into a typewriter; and thereby actuating a single or repeat backspace operation independent of a backspace key.

52. A method for actuating selectively either a single or repeat functional operation for causing the alignment of a selected platen impact point relative to the typewriter print point of a typewriter mechanism independent of a function key, which comprises:

removing an insertable and removable cartridge from a typewriter to thereby effect said single or repeat functional operation.

53. A method for automatically actuating selectively either a single or repeat backspace mechanism of a typewriter which comprises:

removing an insertable and removable ribbon cartridge from a typewriter; and thereby actuating a single or repeat backspace operation independent of a function key.

* * * * *